United States Patent [19]

Cheung

[11] Patent Number: 4,556,343

[45] Date of Patent: Dec. 3, 1985

[54] OFFSHORE OIL STORAGE AND TRANSFER FACILITY

[76] Inventor: Maxwell C. Cheung, 8 Sycamore Creek, Irvine, Calif. 92715

[21] Appl. No.: 579,157

[22] Filed: Feb. 10, 1984

[51] Int. Cl.[4] ..... E02D 29/00

[52] U.S. Cl. ..... 405/210; 141/388; 405/195

[58] Field of Search ..... 405/210, 195, 52, 53; 114/257; 141/288

[56] References Cited

U.S. PATENT DOCUMENTS

| | | | |
|---|---|---|---|
| 3,339,367 | 9/1967 | Lacy | 405/210 |
| 3,610,194 | 10/1971 | Siegel | 405/210 X |
| 3,712,068 | 1/1973 | Liautaud | 405/210 |
| 3,824,942 | 7/1974 | Stafford et al. | 405/210 |
| 3,835,653 | 9/1974 | Hix | 405/210 |
| 4,200,411 | 4/1980 | Brown et al. | 405/210 |

FOREIGN PATENT DOCUMENTS

| | | | |
|---|---|---|---|
| 975975 | 11/1964 | United Kingdom | 405/210 |

*Primary Examiner*—Dennis L. Taylor
*Attorney, Agent, or Firm*—Christie, Parker & Hale

[57] ABSTRACT

An offshore oil storage and transfer facility is provided to receive and store crude oil from one or several sea floor located production wells. The storage facility includes an ellipsoid dome having an outer wall and an inner wall. The inner wall, which defines the closed chamber to receive and store crude oil, is spaced inwardly from the outer wall so as to create a closed pocket therebetween. At or near its top, the chamber communicates with the pocket whereas the pocket, near the bottom of the dome, communicates with the sea. When the storage facility is submerged and positioned, water in the pocket is forced therefrom with compressed air at a pressure substantially equal to the water pressure head existing at the sea floor. The compressed air in the pocket defines a moving bubble. As a result of this moving air bubble, the crude oil is stored in the chamber under pressure and may be unloaded via a suitable conduit to a surface vessel without using submerged pumps. In another embodiment, the storage facility is constructed by assembly of polyhedron-shaped modules to define the desired shape and size. Inner modules are assembled in a three-dimensional lattice-like formation having common passageways between adjacent modules such that the formation functions as the storage chamber. Thick wall modules similar to the inner modules are incorporated into and about the three dimensional lattice-like formation thereby forming the desired protective outer shell. To discharge or unload oil from the facility onto a tanker, pumps supply the crude oil from the storage chamber through a suitable unloading mechanism.

28 Claims, 22 Drawing Figures

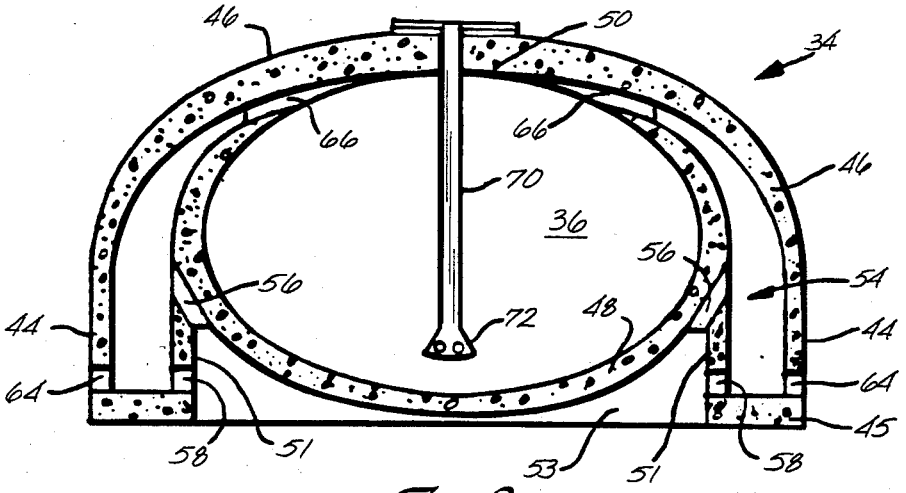
Fig. 2.
Fig. 3.
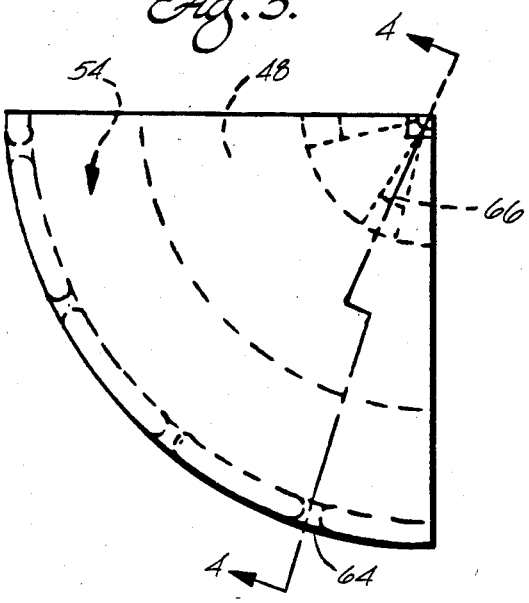
Fig. 4.
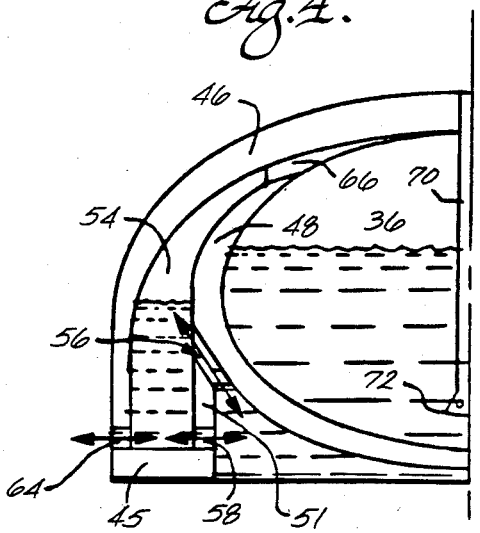

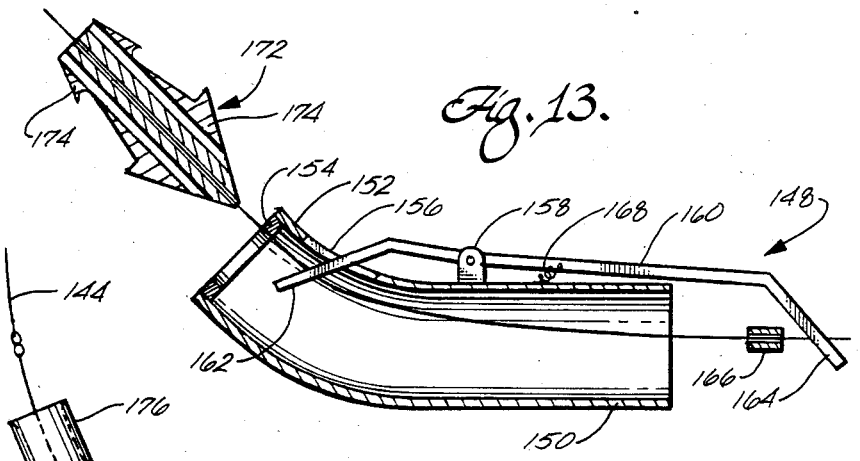
Fig. 13.
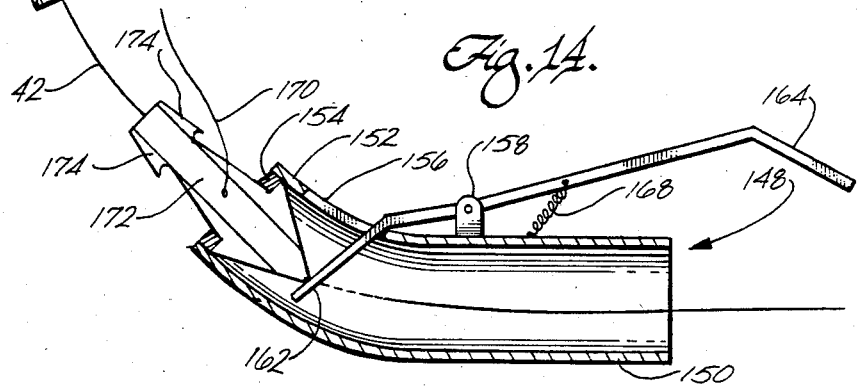
Fig. 14.
Fig. 15.
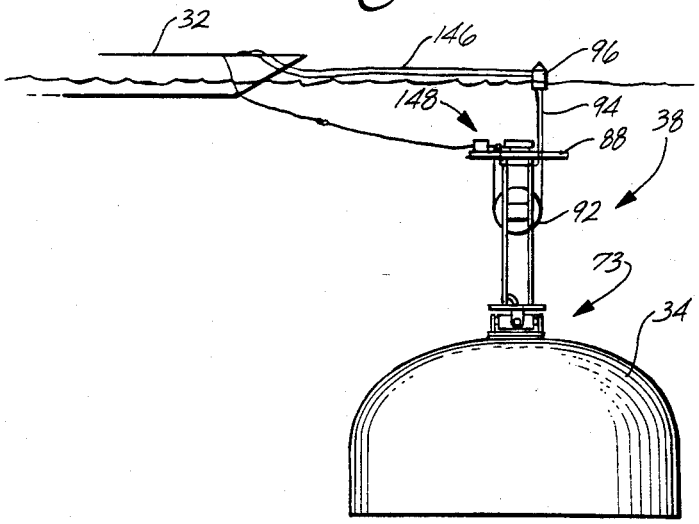

OFFSHORE OIL STORAGE AND TRANSFER FACILITY

FIELD OF THE INVENTION

This invention relates to the offshore storage of crude oil. More particularly, this invention is for underwater storage of crude oil and the transfer of the crude oil to transportation vessels.

BACKGROUND OF THE INVENTION

To meet the ever increasing worldwide demand for crude oil, new reserves have been discovered and exploited at various undersea locations. Development of equipment and methods for finding, drilling, producing, and locating these undersea reserves is expected to continue as the more accessible continental reserves become exhausted.

Once an undersea reserve has been located by any of the known methods, it is necessary to drill one or more production wells. Typically, a plurality of production wells, closely spaced to one another, are drilled from a suitable surface vessel and are thereafter capped. Sometime later, or in lieu of capping the production wells, the crude oil flowing from the wells is combined and joined to a pipeline which extends to an onshore storage facility. Alternatively, the flows are combined into a riser which extends to the surface. From the onshore storage facility or from the offshore riser, the crude oil is loaded on to transportation vessels such as tankers or the like.

A drawback associated with piping the crude oil collected from the production wells to an onshore storage facility is that as exploration moves further from shore, the laying of a suitable pipeline becomes more expensive, based not only upon the overall length of the pipeline, but also upon the underwater terrain which may be encountered. In instances where production wells are drilled in deep waters, on the order of 5000 feet, the laying of a suitable pipeline may become economically or physically unfeasible.

Where the alternate method of combining the flows from the production wells to a riser is used, other drawbacks are encountered. As is often the case, the combined flows from the production wells may be at insufficient flow rates to quickly fill the transportation vessel which is moored on station. The problems of loading the tanker are aggravated in foul weather where quick loading and unhooking from the riser are of utmost importance. Furthermore, the possible oil spill should a vessel encounter the riser.

Accordingly, it can be appreciated that there is a need for an offshore oil storage and transfer facility which is adapted to receive and store crude oil from one or several production wells and, on demand, unload to quickly fill the transportation vessel. The storage facility should be economical to construct and locate, should be safe against oil spills, and should not present an obstruction to shipping. Furthermore, the storage facility should be simple to use, including means for delivering the crude oil, which may include means not requiring pumps.

SUMMARY OF THE INVENTION

There is, therefore, provided in the practice of the present invention an offshore oil storage and transfer facility adapted to receive and store crude oil from one or several sea floor located production wells. The facility is positioned at the sea floor and has a substantially hollow interior defining a chamber which receives and stores crude oil. An outer shell protects the chamber against damage and oil leakage or seepage.

In one embodiment, the storage facility includes an ellipsoid dome having an outer wall and an inner wall. The inner wall, which defines the closed chamber to receive and store crude oil, is spaced inwardly from the outer wall so as to create a closed pocket therebetween. At or near its top, the chamber communicates with the pocket whereas the pocket, near the bottom of the dome, communicates with the sea. For unloading crude oil from the dome, the facility includes an unloading mechanism which remains submerged, except during loading of the tanker, so as not to present an obstacle to shipping or become frozen in ice.

To position the storage facility, the chamber is initially filled with crude oil from a tanker or the like and the pocket is flooded with sea water to submerge the facility. When the facility comes to rest securely at the sea floor, water in the pocket is forced therefrom with compressed air forced into the chamber at a pressure substantially equal to the water pressure head existing at the sea floor. The compressed air displaces the water in the pocket and defines a moving bubble. Thereafter, the chamber is interconnected to one or several wellheads which continuously supply crude oil to the chamber under pressure.

As a result of the aforesaid moving air bubble, the crude oil is stored in the chamber under pressure and may be unloaded via the unloading mechanism to a surface vessel without using submerged pumps that are difficult and expensive to service. Furthermore, the outer wall not only provides ballast for the facility and a pathway for the moving air bubble, but also protects the chamber against damage and prevents oil from leaking to the environment. An additional feature is that the weight of the crude oil in the chamber makes the facility a secure anchor for mooring of tankers.

In another embodiment, the storage facility is constructed by assembly of polyhedron-shaped modules to define the desired shape and size. Inner modules are adapted to function collectively as the storage chamber. Preferably, from a cost standpoint, the inner modules are embodied by mass-produced reinforced-hollow concrete 14-sided polyhedrons. The inner modules are assembled in a three-dimensional lattice-like formation having common passageways between adjacent modules such that the formation functions as the storage chamber.

To protect the inner modules defining the storage chamber from damage, to prevent leaking of oil, and to provide sufficient ballast to maintain the facility at the sea floor, an outer protective shell is provided. The outer shell may be solid or thick wall modules similar to the inner modules set forth above. The outer modules are incorporated into and about the three-dimensional lattice-like formation thereby forming the desired protective outer shell.

Crude oil from one or several production wells is fed into the storage chamber which gradually fills, depending upon the production flow rate. To discharge or unload oil from the facility onto a tanker, pumps supply the crude oil from the storage chamber through the unloading mechanism.

By constructing the storage facility from the polyhedron-shaped modules, the facility is relatively inexpensive to build due to mass production techniques that can be used. Furthermore, the preferred 14-sided modules are inherently strong and capable of withstanding the compressive forces existing at the well site which may be on the order of 5000 feet below the ocean surface.

BRIEF DESCRIPTION OF THE DRAWINGS

These and other features and advantages of the present invention will be appreciated as the same becomes better understood by reference to the following detailed description of the presently preferred embodiments when considered in connection with the accompanying drawings wherein:

FIG. 2 is a side section view of the facility;

FIG. 3 is a top view of a quadrant of the facility of FIG. 1;

FIG. 4 is a section view taken along line 4—4 of FIG. 3;

FIG. 13 is a partial side section view of the latch mechanism for the unloading mechanism;

FIG. 14 is a view similar to that of FIG. 13 showing unlatching of the latch mechanism;

FIG. 15 is a side view of the facility during unloading of oil;

DETAILED DESCRIPTION

Figure 1:
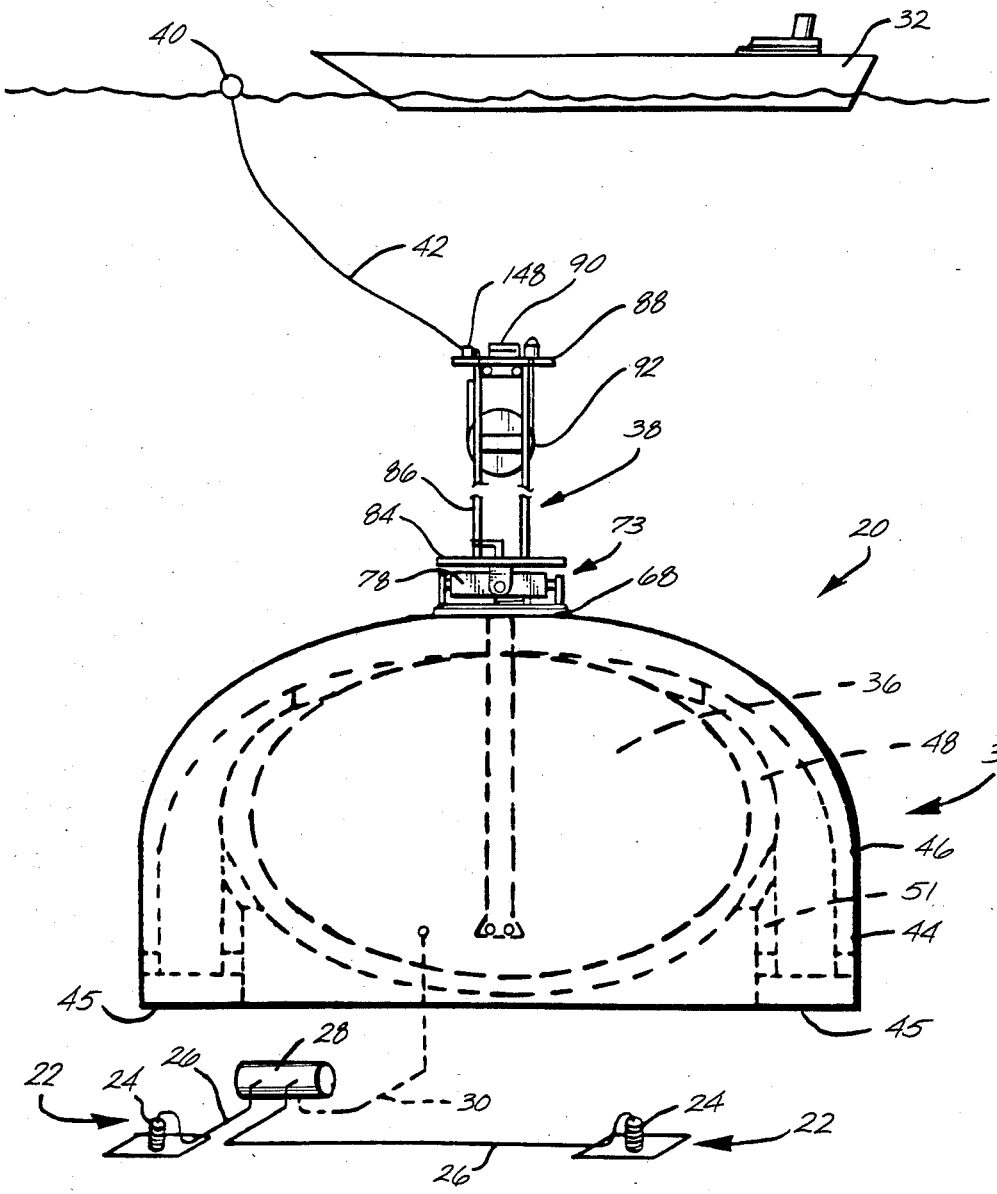
FIG. 1 is a side view of an embodiment of an offshore storage and transfer facility according to the present invention.

Turning to the drawings, FIG. 1 illustrates a preferred embodiment of an underwater oil storage and transfer facility 20 according to the present invention. The facility 20 is adapted to receive and store oil from one or more production wells 22 each having a suitable wellhead 24 at the sea floor. Piping 26 leads from each of the wellheads 24 along the ocean bottom to a valve arrangement, commonly referred to as a christmas tree (not shown), which may be disposed within a closed vessel 28 also disposed at the sea floor. The christmas tree combines the flows from the wells 22 to a common subterranean fill line 30 adapted to supply oil to the facility 20. Of course, it is to be understood that various other methods could be used to transfer the oil from the wells 22 to the facility 20.

It is also to be noted that while the facility 20 is shown in conjunction with production wells 22, it could also function as a strategic oil reserve which would be filled by surface tankers or from a pipeline to store the oil until needed, for example, during times of national emergency.

As stated above, the facility 20 is adapted to receive and store crude oil. The production rate of oil from such well or wells 22 may be at a reduced flow rate and therefore unsuitable for direct transfer to a surface tanker 32. Requiring the tanker 32 to remain moored or on-station for an extended period of time during loading may not be feasible, particularly during foul weather. The facility 20 is also well suited to receive and store oil during periods of the year when surface ice may limit or entirely cut off accessibility to the facility 20.

Accordingly, it is desirable that the facility 20 be adapted to be submerged at a location near the wells 22, have a relatively large capacity, and have the capability of quickly and efficiently unloading crude oil so that the tanker 32 does not have to remain on-station an inordinate amount of time. Preferably, the unloading of crude oil should be accomplished without pumps. Due to the depths involved, unloading pumps would have to be disposed at or near the sea floor. Accordingly, it is to be understood that servicing of the pumps and associated equipment would be expensive in that submarines or the like would be required.

As shown in FIG. 1, the facility 20 consists primarily of a storage dome 34 with an inner chamber 36 and an unloading mechanism shown generally as 38. The unloading mechanism 38, as described in detail below, remains submerged when not in use so as not to present a hazard to shipping and to be protected against damage from shipping, shifting ice packs, or the like. Furthermore, for arctic environments, submergence of the unloading mechanism 38 prevents the mechanism from becoming frozen in the ice. The unloading mechanism 38 includes a surface marker buoy 40 tethered to the unloading mechanism 38 by a marker buoy line 42. The marker buoy 40 indicates the location of the facility 20.

As can be appreciated from the drawings, the dome 34 has a generally ellipsoid shape with a downwardly depending, encircling skirt 44 which includes a flat bottom 45 adapted to rest on the sea floor. Of course, it is to be understood that the dome 34 may be of any other suitable shape such as hemispherical or the like. Should the site at the wells 22 be unsuitable, some site preparation as by dredging or the like may be required.

The dome 34 is constructed at, for example, a dry dock facility and has an outer wall 46 (FIGS. 2–4) which defines the ellipsoid shape and also the outer perimeter of the skirt 44. Preferably, the outer wall 46 is fashioned from reinforced concrete, however other suitable materials could also be employed. The outer wall 46 is closed and provides a barrier against seawater entering the dome 34. Additionally, the outer wall 46 provides ballast to permit the dome 34 to serve as an anchor for the tanker 32 and protects the chamber 36 from damage.

Spaced inwardly from the outer wall 46 is an inner wall 48. Like the outer wall 46, the inner wall 48 is preferably fashioned from reinforced concrete and is closed to define the chamber 36 to receive and store crude oil. The inner wall 48 is ellipsoid in shape and is interconnected and spaced from the outer wall 46 at its uppermost extent by an upper node 50. The upper node 50 represents, in essence, the intersection of the inner and outer walls 48 and 46 and is preferably fashioned from reinforced concrete and may be made contemporaneously with either or both of the outer and inner walls 46 and 48.

To further support the chamber 36 and define the inner perimeter of the skirt 44, the dome 34 includes a ring 51. The ring 51, preferably fashioned from reinforced concrete, extends downwardly, at approximately a tangent to the chamber 36, to intersect with the bottom 45. In combination with the lower extent of the outer wall 46, the ring 51 and bottom 45 define the skirt 44.

As seen in FIGS. 1 and 2, the space beneath the chamber 36 within the ring 51 defines a bowl-shaped lower void 53 the purpose of which will hereinafter become evident. Additionally, the space between the outer wall 48 and ring 51 creates an encircling void 55. To provide for communication between the aforesaid voids 53 and 55, the ring 51 has a plurality of upper and lower apertures 56 and 58 respectively. The upper apertures 56 are positioned adjacent to the inner wall 48 and are angled somewhat downwardly to be approximately tangential to the inner wall 48. The lower apertures 58 are located adjacent to the bottom 45 and are substantially horizontal.

As can be appreciated, particularly in FIG. 2, the lower and encircling voids 53 and 55 cooperate to define a closed pocket 54. The pocket 54 extends from beneath the inner wall 48 to the upper node 50 to surround the inner wall 48.

Referring to the entire dome 34, it can be understood that between the outer boundary of the dome 34 and the chamber 36 defines a certain volume hereinafter referred to as the total volume. It can also be understood that the open volume represented by the pocket 54 is a portion of the total volume. It has been determined that for proper ballast and for the operation of the facility 20 as hereinafter set forth, the ratio between the available, open volume, i.e., the volume of the pocket 54, and the total volume (hereinafter referred to as the void ratio) should be approximately 0.50 and is preferably 0.563.

To cooperate with other features of the facility 20 and to provide a means to lift the crude oil from the chamber 36 to the tanker 32, the skirt 44 is provided with a plurality of ports 64 each of which passes through the outer wall 46 (FIGS. 2 and 4). Each port 64 is located near but above the bottom 45 such that when the facility 20 rests on the sea floor the port 64 will not become clogged with sand or the like. During transportation of the dome 34 to the site, it may be necessary to close one or more of the apertures and ports 64 to give the dome 34 suitable buoyant and ballast characteristics. To submerge the dome 34, and for operation thereof as hereinafter set forth, all ports 64 and apertures are opened to permit sea water to flow into and out of each segment 58.

To provide communication between the chamber 36 and the pocket 54, the inner wall 48 at the upper node 50 has a number of holes 66.

To deliver crude oil, a conduit is required between the chamber 36 and the tanker 32. Since the dome 34 may be located in 1000 feet or more of water, surface pumps should not be used. Pumps disposed under water, at or chamber 36 onto the tanker 32 would be difficult and expensive to service, maintain and power. Accordingly, the facility 20 is provided with a means for unloading the chamber 36 onto a tanker 32 without requiring pumps.

To provide a conduit through which the crude oil may be lifted, and to provide for the initial charging of the dome 34, as fully set forth below, and to provide for mooring of the tanker 32, the unloading mechanism 38, as shown in FIGS. 9–12, is provided. The unloading mechanism 38 is adapted to remain completely submerged during periods of non-use so as not to present a hazard to shipping or to itself should a ship collide with the unloading mechanism 38. Also, the submerged unloading mechanism 38 is not subject to being engaged by ice or becoming frozen in the ice. As can be appreciated, damage to the unloading mechanism 38 would lead to an oil spill.

Figure 9:
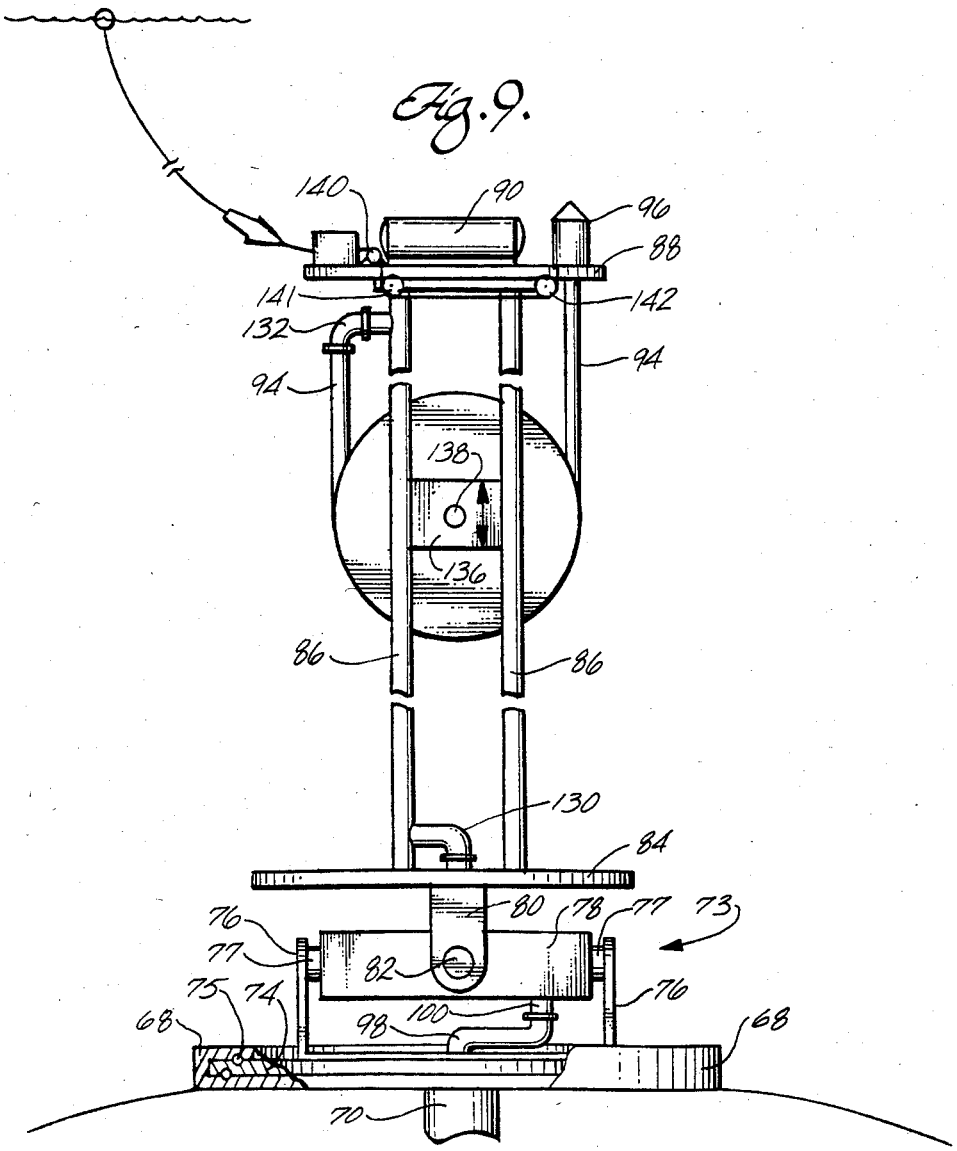
FIG. 9 is a side view of an unloading mechanism adapted to unload oil from the facility to a vessel.

The unloading mechanism 38 includes a base 68 secured to the top of the dome 34. The base 68 may be secured by bolts or the like and has an unloading pipe 70 extending therefrom through the upper node 50 and into the chamber 36. The unloading pipe 70, as shown in FIGS. 1 and 2, extends down into the chamber 36 to have a terminus above the lower extremity thereof. At its terminus, a foot 72 may be provided to prevent debris which may enter the chamber 36 from entering and clogging the unloading pipe 70. The unloading pipe 70 is sealed within the upper node 50 and terminates with a suitable flange or the like just above the base 68 as shown in FIG. 9.

In that ocean currents may engage the unloading mechanism 38 from any direction and exert a bending force thereon, the unloading mechanism 38 is provided with a gimbal 73 adapted to permit the mechanism to tilt and rotate in response to the aforesaid ocean currents. Rotation of the mechanism is important to prevent the marker buoy line 42 from fouling about the mechanism. The gimbal 73 includes a table 74 rotatably supported by the base 68 with a plurality of bearings 75. The pipe 70 projects upwardly above the table 74.

Figure 10:
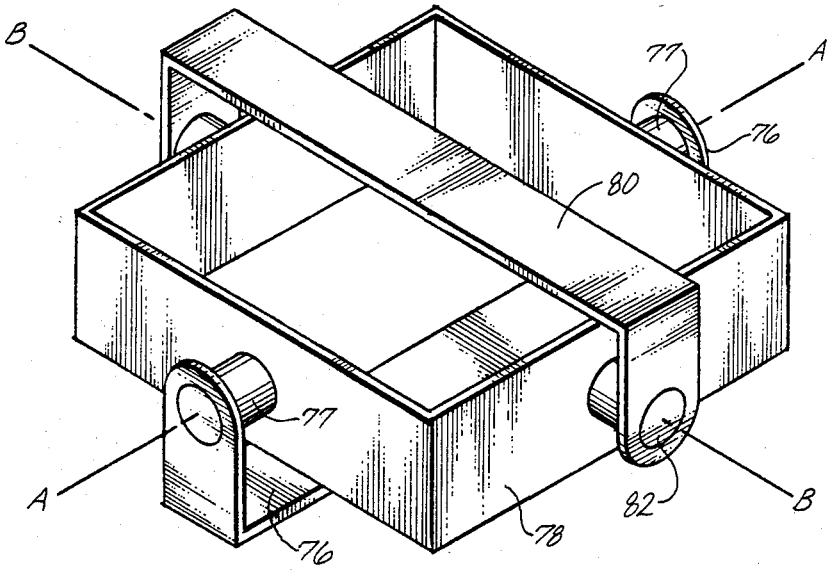
FIG. 10 is a perspective view of the gimbal for the unloading mechanism of FIG. 9.

While the table 74 is shown as being a substantially solid disc, it is to be understood that it could also be ring-shaped to better accommodate the pipe 70. Secured to the table to rotate therewith is a lower yoke 76. The lower yoke 76 supports, via a pair of coaxially arranged pins 77, a box 78. The pins 77 are rotatably mounted to the lower yoke 76 and permit the box 78 to pivot about an axis A (FIG. 10). In turn, the box 78 supports an upper yoke 80 via another pair of coaxially arranged pins 82. Pins 82 are rotatably supported by the upper yoke 80 to permit the upper yoke 80 to freely pivot about axis B arranged orthagonal to axis A. Upper yoke 80 is attached to the underside of a plate 84 which, by virtue of the gimbal 73 is free to rotate and to pivot about one or both of the A and B axes.

Fastened to the plate 84 are four legs 86 which may be fashioned from lengths of pipe. The legs extend upward from the plate 84 and the dome 34 and are attached at their uppermost ends to a platform 88. Each of the legs 86 is of a length to locate a platform 88 at a depth below the water surface so as not to be engaged by ships or ice. Mounted to the platform 88 is a ballast tank 90 adapted to maintain the legs 86 in tension to prevent collapse and to vertically orient the legs. As can be appreciated, the gimbal 73 permits the leg-platform structure to rotate and pivot in response to the ocean currents.

To provide a means for delivering crude oil from the chamber 36, a hose reel 92 is disposed between and is vertically movable along the legs 86. Partially wrapped about the reel 92 is a supply hose 94 of a length sufficient to extend from the unloading mechanism 38 to the surface with a sufficient degree of slack so that the hose 94 may be retrieved by and supply crude oil to the tanker 32. One end of the hose 94 mounts a supply buoy 96 which is buoyant but which remains submerged when the unloading mechanism 38 is not in use. As shown in FIG. 10, the platform 88 may be provided with a suitable opening to guide the hose 94 when the supply buoy 96 is released for travel toward the surface. As will be described below, when a tanker 32 desires to be loaded with crude oil from the chamber 36, the unloading mechanism 38 is manipulated such that the supply buoy 96 can float upward to the surface carrying with it the supply hose 94 which is heave compensated by the reel 92.

Figure 12:
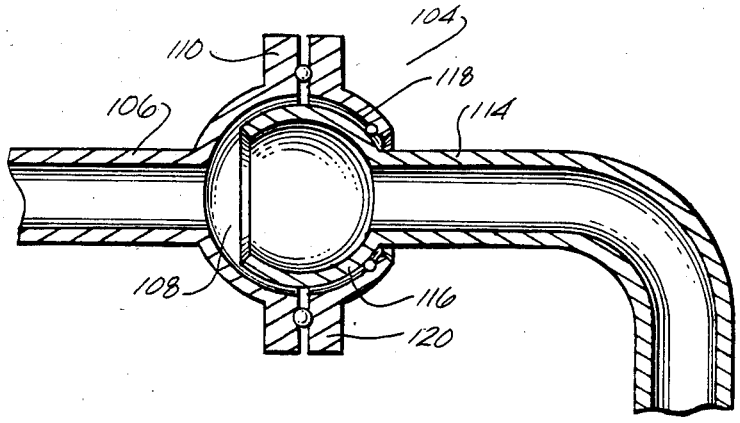
FIG. 12 is a side section view of a coupling for the piping of FIG. 11.
Figure 11:
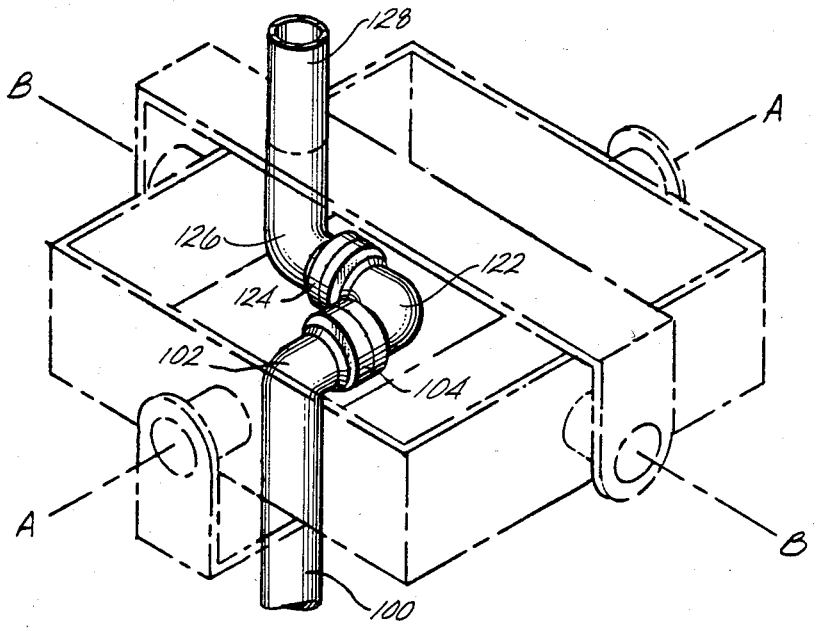
FIG. 11 is a perspective view of a portion of the piping for unloading of oil from the facility.

To provide communication between the unloading pipe 70 and the hose 94, and to allow for the gimballed movement of the unloading mechanism, a piping system as shown in FIGS. 10 and 11 is provided. From the pipe 70 a short supply elbow 98 is connected to a first riser 100. The first riser 100 terminates at a first elbow 102 which mounts a first coupling 104. As shown in FIG.12, the first coupling 104 is adapted to permit relative rotation of connected pipes. Accordingly, the first coupling 104 has a female pipe 106 which includes a hemispherical socket 108. The socket 108 terminates at a flange 110. Received into the socket 108 for rotation relative thereto is a male pipe 114 and more particularly its ball 116. In the instant case the first elbow 102 may represent the male pipe 114. To retain the ball 116 in the socket 108 a hemispherical retainer 118 in effect traps the ball 116 in the socket 108. The retainer 118 has a flange 120 adapted to be connected by bolts or the like to the flange 110. Ring seals 122 and 123 are provided at, respectively, the flanges 110, 120 and in the retainer 118 about the ball 116 to prevent oil from leaking from the first coupling 104. As can be appreciated the first coupling 104 permits the female and male pipes 106 and 114 to rotate coaxially about axis A relative to each other to accommodate motion of the gimbal about that axis. From the first coupling 104 a second elbow 122, arranged horizontally, leads to a second coupling 124. The second coupling 124 is identical to the first coupling 104 and connects the second elbow 122 to a vertically arranged third elbow 126 for relative rotation. Accordingly, the second and third elbows 122 and 126 are free to pivot about axis B to accommodate motion of the gimbal about that axis. From the third elbow 126 a second riser 128 which, as shown in FIG. 9, extends through the plate 84. A fourth elbow 130 is attached to the second riser 128 and is, in turn, connected to one of the legs 80 which functions as a conduit to supply the crude oil upwardly toward the platform 82. Near the platform 82, another elbow 132 is provided to direct the crude oil supply to the flexible feed hose 94 which is directed downwardly from the platform about the reel 92 and back to the platform 88 for connection to the supply buoy 96. Accordingly, as the reel 92 moves upwardly and downwardly along the legs 86, the hose 94 is permitted to travel toward and beneath the surface. It is to be noted that the reel 92 is weighted to function as a heave compensator for the hose 94 and supply buoy 96.

To provide for surfacing and submerging of the supply buoy 96, the reel 92 is rotatably supported by a slide 136 such as shown in FIG. 9. The slide 136 is adapted to slide upwardly and downwardly between pairs of the legs 86. A shaft 138 rotatably mounts the reel 92 to the slide 100. Accordingly, as the slide 100 moves upwardly and downwardly along the legs 80 to permit the supply buoy to surface and submerge, the shaft 138 permits the reel 92 to rotate and, in effect, functioning as a pulley, pass the hose 94 as the supply buoy 96 surfaces or submerges carrying the hose 94 therewith. The reel 92 is weighted to be slightly less buoyant than the supply buoy 96 and hose 94 to permit the supply buoy when released to float to the surface and, at the same time, act as a heave compensator for the supply buoy 96 when it is at the surface.

The buoyancy of the supply buoy 96 is such that the slide 136 is normally urged to move upward toward the platform 88. To provide a means to restrain the movement of the slide 136 toward the platform 88 and to provide a means to move the slide 136 downwardly and submerge the supply buoy 96, the marker buoy line 42 is connected to the supply buoy 96 as best shown in FIG. 9. The marker buoy line 42 is passed about a series of pulleys 140 through 142 mounted to the platform 88. The rotation of the unloading mechanism 38 prevents the marker buoy line 42 from fouling around the other components of the unloading mechanism 38.

To raise the supply buoy 96 to the surface, personnel aboard the tanker 32 retrieve the marker buoy line 42, remove the marker buoy 40 and attach to the line a suitable length of lead line 144 (FIG. 14). The lead line 144 is played out from the tanker and, due to the buoyancy of the supply buoy 96, the slide 136 moves upwardly along the legs 80 as the supply buoy 90 rises to the surface. When the supply buoy 96 is at the surface, personnel aboard the tanker 32 retrieve the supply buoy 96 and connect thereto a feed line 146 as shown in FIG. 15. Upon opening a valve, crude oil from the chamber flows through the unloading mechanism 38 to the feedline 146 and eventually to the tanker 32.

Once unloading of the chamber 36 is completed the feed line 146 is disconnected and winching mechanisms or the like retrieve the lead line 144 and attached marker buoy line 42. Retrieval of the lead line 144 pulls the slide 136 downwardly submerging the supply buoy 96. When the supply buoy 96 reaches the platform 82, the marker buoy line 42 is at the surface. The lead line 144 is disconnected and the marker buoy 40 is reattached and cast into the sea.

Since the marker buoy 40 may have insufficient buoyancy in and of itself, to maintain the slide 136 at its lowermost point, means are required for latching the marker buoy line 42 to prevent the 136 slide from moving upwardly. Means are also required to release the marker buoy line 42 so that the marker buoy line 42 may travel around the pulleys 140–142 and permit the slide 136 to move upwardly for surfacing of the supply buoy. In conjunction with release of the marker buoy line 42, it would be convenient that the release of the marker buoy line 42 results in the mooring of the tanker 32 to the facility 20. Accordingly, turning to FIGS. 13 and 14, an exemplary latching mechanism 148 for the unloading mechanism 42 is shown.

The latching mechanism 148 includes a sleeve 150 mounted to the platform 88 which passes the marker buoy line 42. The sleeve 150 may have one end 152 turned upward to better receive and guide the marker buoy line 42. At the one end 152, an annular collar 154 and a top opening 156 are provided for purposes which will hereinafter become evident. Mounted to the outside and above the sleeve 110 is a support 158 which mounts and provides the fulcrum for a link arm 160. One end of link arm 160 extends through the top opening 156 to define a finger 162 which may be bifurcated to span the marker buoy line 42. The other end of the link arm 160 extends past the sleeve 150 to define a fork 164 which is bifurcated to extend to either side of the marker buoy line 42. In the position shown in FIG. 13, the marker buoy line 42 is held by the latching mechanism 148 preventing the slide 136 from moving upwardly toward the platform 88. To hold the marker buoy line 42, a nock 166 is provided on the marker buoy line 42, the nock 166 engaging the fork 164 to prevent movement of the marker buoy line and slide 136. To maintain the link arm 160 and the latched position as shown in FIG. 13, a spring 168 may be provided between the link arm 160 and the sleeve 150.

To release the marker buoy line 42 for surfacing of the supply buoy 96, and at the same time providing a means for mooring the tanker 32, a mooring line 170 is provided at its end with a stab fitting 172 such as that shown in FIGS. 13 and 14. Upon arrival at the site, personnel aboard the tanker 32 retrieve the marker buoy 40 and connect thereto the lead line 144 as described above. The lead line 144 is connected to a suitable winch on board the tanker 32. The crew also attaches the stab fitting 172 about the marker buoy line 42, the stab fitting 172 being non-buoyant and having secured thereto the mooring line 170. The stab fitting 172 is slipped downwardly along the marker buoy line 42, the stab fitting 172 being provided with one or more spring-loaded fins 174. Upon encountering the sleeve 150, the fins 174 are depressed permitting the stab fitting 172 to pass through the collar 154 and engage the finger 162. Ultimately, the stab fitting 172 enters the sleeve 150 whereupon the fins 174 extend, locking the stab fitting 172 within the sleeve 150 and mooring the tanker 32 to the facility for subsequent unloading of the chamber 36. The contact between the stab fitting 172 and the finger 162 causes the link arm 160 to pivot, releasing the nock 166 and permitting the marker buoy line 42 and lead line 144 to be played out and the supply buoy 96 to surface.

Upon termination of the loading procedure, the lead line 144 is retrieved, pulling the marker buoy line 42 and submerging the supply buoy 96. When the nock 166 engages the stab fitting 172, retrieval of the lead line is terminated. Thereafter, a release collar 176 is sent down the marker buoy line 42 to engage and cause retraction of the fins 174 to release the stab fitting 172 from the sleeve 150. Thereafter, the stab fitting 172 and mooring line 170 are retrieved and the latching mechanism again restrains the marker buoy line 42 via the link arm 160. The marker buoy 40 is reattached to the marker buoy line 42 and cast overboard. Of course, it is to be understood that the unloading mechanism 38 and latching mechanism 148 described above are not to be deemed limiting. Other suitable devices and methods can be used.

Figure 6A:
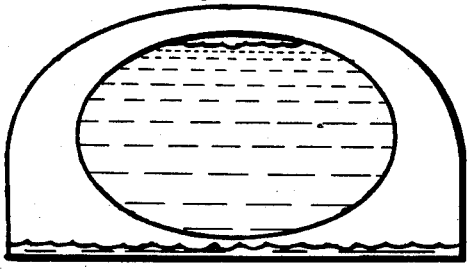
FIGS. 6A through 6C are side views of the facility showing loading and unloading.
Figure 6B:
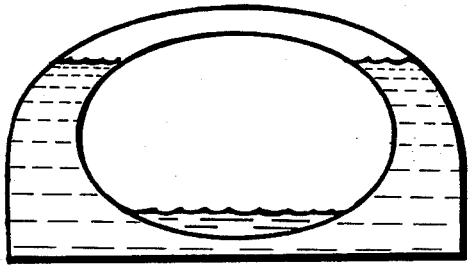
Figure 6C:
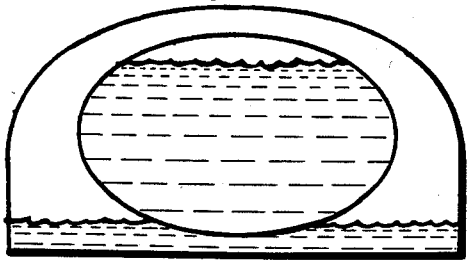

Returning to FIGS. 2–4, and 6A–6C, the location and operation of the facility 20 and more particularly the dome 34, will be described. Upon arrival at the site, the chamber 36 is initially filled with oil. Thereafter, the ports 64 and apertures are opened permitting water to flood the pocket 54, causing the dome 34 to descend toward the desired site. Before descent, the loading mechanism 38 is assembled on its side at the surface and is attached to the dome 34. As the dome 34 comes to rest on the ocean floor, the pocket 54 is almost entirely flooded with sea water. Retrieving the supply buoy 90 in the manner described above, compressed air from a surface vessel is forced down through the hose 88 to charge the dome 34. The compressed air enters the chamber 36 and bubbles upward, passing through the holes 66 to force sea water from the pocket 54 outwardly through the ports 64, and upper and lower apertures 56 and 58. When the pocket 54 has been purged of sea water, as indicated by bubbles rising to the surface, the flow of compressed air is stopped and the supply hose 94 is connected to a suitable oil tank. By virtue of the compressed air in the pocket 54, the unloading mechanism 58 is filled with oil which is safely discharged into the tanks and the flow is stopped, such that the free surfaces of oil in the chamber 36 and seawater in the pocket 54 are substantially as shown in FIG. 6C. The air in the dome 34 is at a pressure equal to the pressure head of the sea water at the ports 64. The oil urged from the chamber 36 has been replaced by compressed air entering through holes 66, whereas seawater has entered the ports 64. Thereafter, the supply buoy 96 is submerged and the wellheads 24 which have an oil pressure greater than the pressure of the air bubble are opened to refill the chamber 36. The free surfaces of the oil in the chamber 36 and seawater in the pocket 54 appear as illustrated in FIG. 6A. During the unloading of the oil from the chamber 36, the compressed air bubble occupying the pocket 54 and pressurizing the oil shifts into the chamber 36 through the holes 66 while seawater again fills the pocket 54. When the chamber 36 is substantially empty as shown in FIG. 6A the oil free surface is at its lowermost position and the chamber 36 is ready to receive crude oil from the wellheads 24. As the chamber 36 becomes filled with crude oil, the compressed air bubble within the chamber 36 is displaced which, through the holes 66, in turn displaces the seawater in the pocket 54. When the chamber 36 is substantially filled with oil, as shown in FIG. 6A, the air bubble has again displaced substantially all of the seawater from the pocket 54.

The compressed air bubble in the pocket 54 provides the force or energy necessary to lift the crude oil from the chamber 36 to the surface without requiring pumps or the like. Due to the configuration of the pocket 54 and chamber 36, the air pressure varies somewhat depending upon the level of crude oil in the chamber. However, regardless of the level of crude oil, the facility 20 may be unloaded simply and automatically merely by opening a valve in the supply buoy 90. The air bubble urges the crude oil to the surface at a flow rate consistent with rapid loading of the tanker 32. Accordingly, unloading of the facility 20 is simple and is not dependent upon mechanical equipment such as submerged pumps which would be difficult to service.

Figure 5:
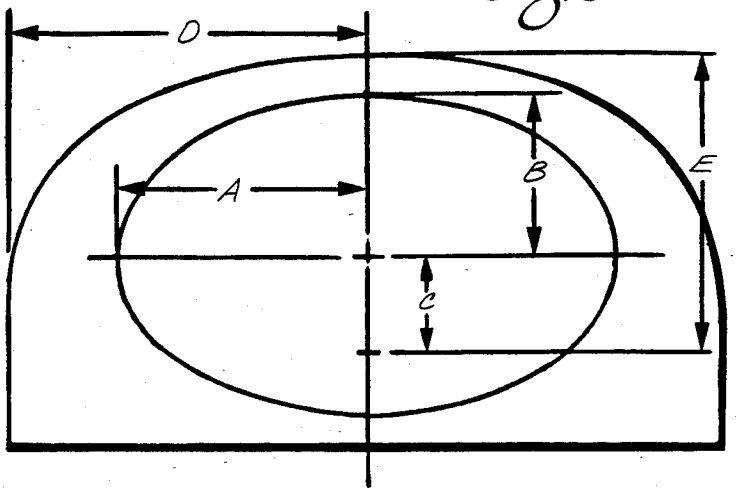
FIG. 5 is a view similar to that of FIG. 2 and illustrates the dimensions of the preferred embodiment.

Referring to FIG. 5, exemplary characteristics of a dome 34 will be given. The following is by way of illustration and is not deemed to be limiting. The dome 34 of FIG. 5, is to be disposed of at a water depth of 1000 ft. The chamber 36 one-half major axis A is 70 feet whereas the chamber 36 one-half minor axis is 41.5 feet. The outer wall 46 one-half major axis D is 98.4 feet whereas the outer wall 46 one-half minor axis E is 60 feet. The centerline offset C for the outer wall 46 is 8.5 feet and the clearance between the bottom 44 and the ports 64 is 8 feet. The dome void ratio is 0.563 and the crude oil density is 51.00 lbs/cubic foot whereas the concrete density is 164 lbs/cubic foot. Given the dimensions above, the dry weight of the concrete of the dome 34 is assumed to be $0.11554 \times 10^9$ lb.

Finally, the effective weight of the dome is maximum when the chamber is empty since water is heavier than oil.

Figure 7:
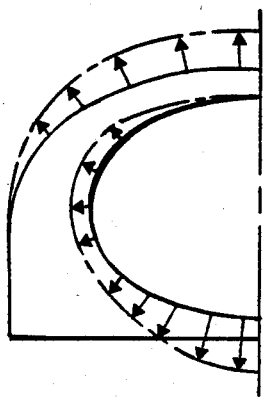
FIG. 7 is a representative section view of the facility showing the profile of forces when the facility is full.
Figure 8:
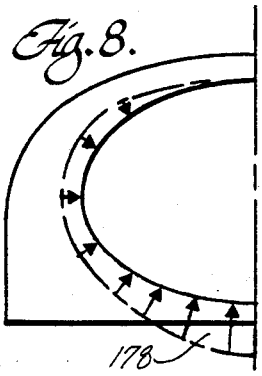
FIG. 8 is a view similar to FIG. 7 showing the profile of forces when the facility is empty.

Turning to FIGS. 7 and 8, the force distribution on the dome 34 and its chamber 36 is shown. When the chamber is empty as shown in FIG. 8, the forces across the outer wall 46 are balanced whereas compressive forces 178 are distributed upon the inner wall 48 by virtue of the static head or column of water in the pocket 54. When the chamber 36 is full of oil as shown in FIG. 7, the compressed air within the pocket 54 results in a net outwardly directed force 180 on the outer wall 46 with the static head of the crude oil in the chamber resulting in a net outwardly directed force 182 upon the inner wall 48. Since the air pocket within the pocket is at a pressure equal to the sea at a level represented by the outlet port, it can be appreciated that this pressure subsists throughout the pocket resulting in an outwardly directed force on the outer wall as the static pressure head of the sea on the outer wall decreases from the port to the top of the dome. As can be appreciated, the forces imposed upon the inner and outer wall result from fluid heads. Accordingly, by providing the ellipsoid shape rather than, for example, hemispherical, these forces can be minimized while retaining maximum storage capacity. It is to be understood that the overall dimensions of the dome vary in relation to the desired depth at which it is to be used.

Figure 16:
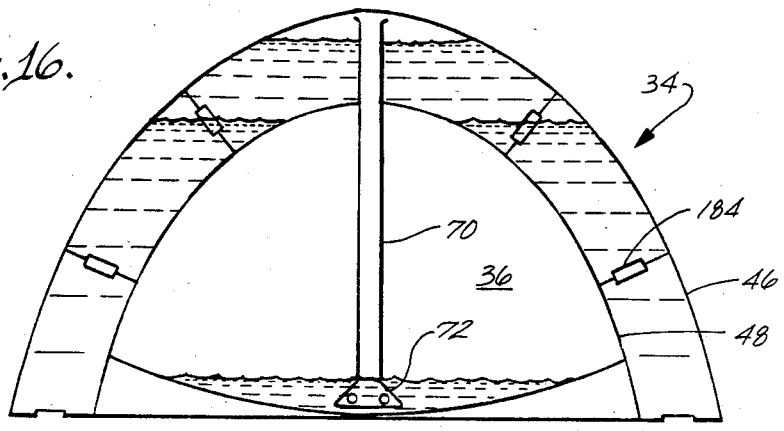
FIG. 16 is an elevation view of another embodiment of the oil storage transfer facility.

Turning to FIG. 16, an alternative embodiment of the facility dome 34 is shown. The dome of FIG. 16 includes a series of couplers 184 to interconnect and support the inner and outer walls. The couplers 184 may be cables or may be rods having threaded ends adapted to be received by a threaded sleeve or the like to tension the rods.

At FIGS. 17–20, a further embodiment of a facility 200 is shown. The facility 200 is fashioned from assembling, in a lattice-like fashion, a plurality of hollow oil storing inner modules 202 and protective ballast-providing outer modules 204. For a given facility 200, all the modules are substantially the same which lends the modules to mass production thereby minimizing construction costs.

The inner modules 202 are hollow and are adapted to collectively provide storage for crude oil and define a storage chamber. To enable the modules to be assembled into a closed (i.e., no spaces between adjacent modules) lattice-like formation, each inner module 202 is polyhedron-shaped. Preferably as shown in FIGS. 15 and 16, the inner modules 202 are fourteen-sided polyhedrons. More specifically, each is a truncated octahedron having eight sides defining hexagonal sides 206 and six square panels 208. Preferably, the sides 206 and panels 208 are fashioned from reinforced concrete and have a size dependent upon the depth of the intended site. For example, in deep water on the order of 5000 feet, the modules have a diameter of 5 feet, whereas at a depth of about 500 feet, the modules may have a diameter of 10 feet. By providing the modules of the shape and size described above, each module is inherently strong against compression and is adapted to be assembled into a closed lattice-like formation defining a storage dome 210.

Figure 19:
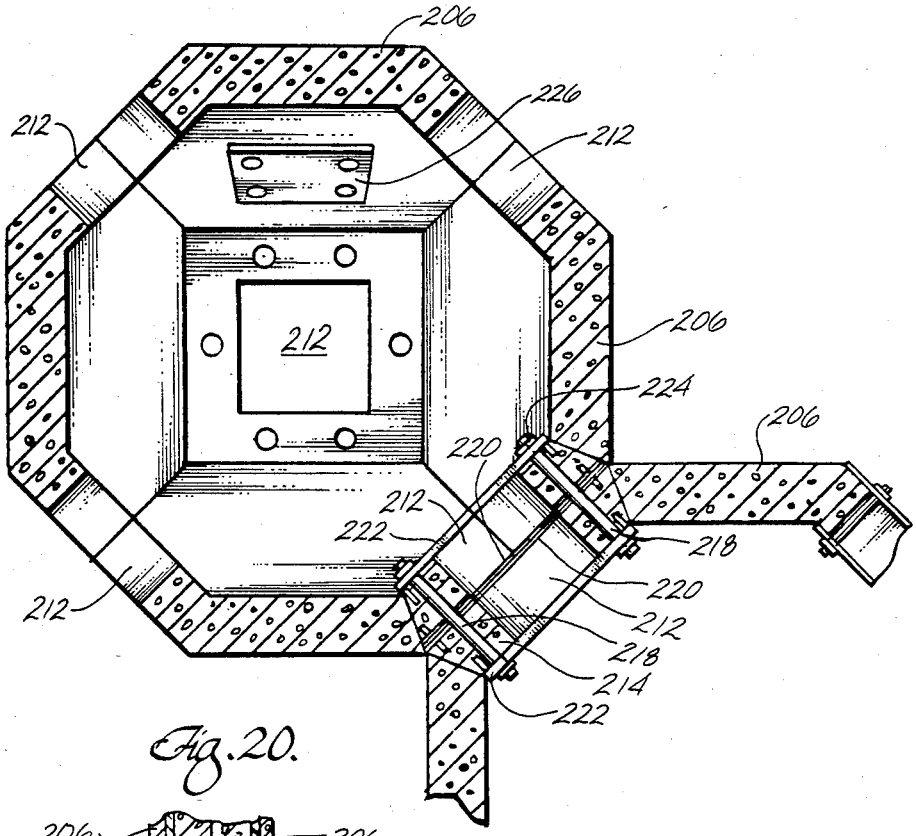
FIG. 19 is a side section view showing interconnection of the modules.
Figure 20:
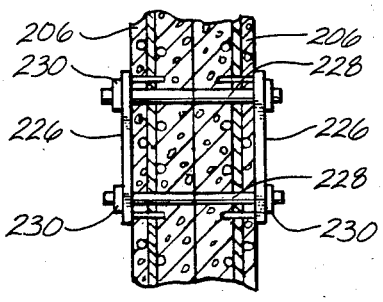
FIG. 20 is a section view illustrating a further interconnection of the modules.

As stated above, the inner modules 202 are hollow to hold a quantity of crude oil. To interconnect the inner modules 202 to permit the oil to freely flow among the inner modules 202 connecting means such as those shown in FIGS. 19–20 are required. It is to be understood that the connecting means hereinafter set forth are by way of illustration only and should not be deemed as limiting.

Figure 17:
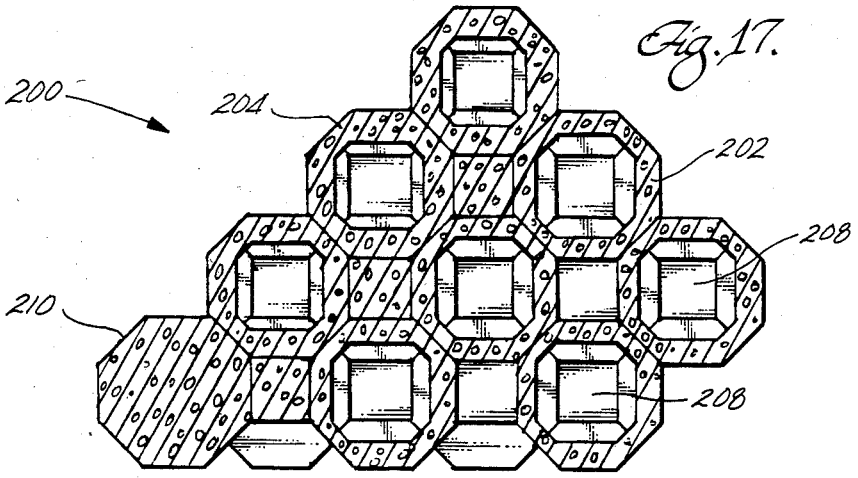
FIG. 17 is a view of yet another embodiment of the oil storage and transfer facility constructed from a lattice work of polyhedron-shaped modules.

Depending upon the location of the inner module 202, one or more of the panels 208 has a rectangular passageway 212 therethrough. The module shown at FIG. 19 is well within the lattice and therefore has a passageway 212 cut or formed in each panel 208 to provide communication with adjacent inner modules 202. In that the passageway 212 is spaced from the edges of the panels, a rectangular lip 214 is defined bordering each passageway 212. Extending through each lip 214 are a plurality of bores each adapted to closely pass a threaded bolt 218. If desired, the bores may be formed by drilling or sleeves may be cast into the concrete for this purpose. When the formation is assembled, the lips 214 of adjacent inner modules 202 mate as shown in FIG. 17. To provide a seal, metallic face plates 220 may be disposed about the outer surface of each lip 214 and grouting may be disposed therebetween.

About the inner surface of the lips, flat metallic frames 222 are provided, each having a pattern of holes to align with the bores. The bolts 218 are passed through the frames 222 and bores and nuts 224 are threaded and tightened upon each end to sealably secure the lips 214 together. Accordingly, oil is free to flow through the passageways 212 between the inner modules 202.

Figure 18:
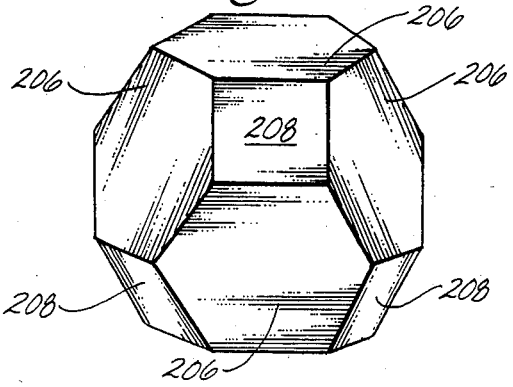
FIG. 18 is a perspective view of one of the modules of FIG. 15.

For additional support, one or more sides 206 may be provided with a connecting plate 226 which may be interconnected with reinforcing members in the concrete as shown in FIG. 18. Holes pass through the connecting plates 226 and sides 206 to receive threaded bolts 228. Nuts 230 threaded and tightened upon both ends of each bolt 228 to connect the inner modules 202.

To protect the inner modules 202 and to provide ballast for the facility 200, the outer modules 204 are integrated into the lattice about the outside of the inner modules 202 as shown in FIG. 15. The outer modules 204 may be solid concrete or may be hollow having thicker sides and panels than the inner modules 202.

To receive oil, the facility 200 includes the fill line as described above and to unload the facility includes the unloading mechanism, also as described above. To lift the oil through the unloading mechanism 38, supply pumps (not shown) at the facility 200 are required rather than using the moving air bubble described above. The supply pumps lift the oil from the storage chamber defined by the lattice of inner modules 202 through the unloading mechanism 38 to the surface.

While I have shown certain embodiments of the present invention, it is to be understood that it is subject to many modifications without departing from the scope of the claims hereinafter set forth.

What is claimed is:

1. An offshore oil storage and transfer facility adapted to be disposed underwater comprising:

a dome including an inner wall defining a closed chamber to receive and store oil and an outer wall spaced outwardly from the inner wall to define a closed pocket disposed about the chamber, said inner wall including an uppermost hole to provide communication between the chamber and pocket and the outer wall including a lowermost port to provide communication between the pocket and the water;

a conduit adapted to extend from the chamber upward for unloading the oil from the chamber to a vessel; and a bubble of compressed gas adapted to shift between the pocket and the chamber to urge the oil from the chamber through the conduit to the surface for transferring of the oil to a surface tanker and to shift from the chamber to the pocket in response to filling of the chamber with oil.

2. The facility of claim 1 wherein the bubble of compressed gas is at a pressure substantially equal to the water pressure head at the ports.

3. The facility of claim 1 wherein the dome outer and inner walls are ellipsoid.

4. The facility of claim 1 wherein the dome rests on the sea floor and includes a skirt adapted to support the inner wall, the skirt being defined by a portion of said outer wall and a ring depending downwardly from the inner wall to support the inner wall above the sea floor and define a closed void beneath the inner wall.

5. The facility of claim 4 wherein the ring includes a plurality of apertures providing communication between the void and pocket whereby the void co-acts with the pocket for the shifting of the air bubble.

6. The facility of claim 4 wherein the dome includes an upper node interconnecting the inner and outer walls to provide mutual support therefor.

7. The facility of claim 6 wherein the ratio of the volume of the pocket and void to the total volume of the dome, exclusive of the chamber volume, is approximately 0.50.

8. An underwater oil storage and transfer facility comprising:

a dome disposed at a preselected depth, the dome including an ellipsoid inner wall defining a closed chamber to receive oil and an ellipsoid outer wall disposed about and spaced from the inner wall to define a closed pocket, the inner wall including at approximately its uppermost extent a hole communicating between the chamber and the pocket and the outer wall including at its approximately lowermost extent a port between the pocket and the water at said depth; and means for conducting the oil from the chamber to a surface tanker, said chamber when empty adapted to contain a compressible fluid at a pressure substantially equal to the water pressure head at the preselected depth and the pocket adapted to be substantially filled with water, filling of the chamber with oil displacing the compressed air through the hole into the pocket and displacing the water from the pocket through the port, said compressible gas urging the oil to flow through the conducting means to the tanker.

9. The facility of claim 8 wherein said pocket has a void ratio of about 0.50.

10. The facility of claim 9 wherein said pocket has a void ratio of 0.563.

11. The facility of claim 8 further including means for mooring the tanker.

12. The facility of claim 8 wherein the conducting means includes an unloading mechanism adapted to remain submerged, the unloading mechanism including a buoyant supply buoy, means for releasing the supply buoy to float to the surface and carry therewith a supply hose adapted to transport oil from the chamber to the tanker.

13. The facility of claim 12 wherein the unloading mechanism includes means for heave compensating the supply buoy.

14. The facility of claim 13 wherein the heave compensating means is a reel disposed at the submerged unloading mechanism and vertically moveable in response to release of the supply buoy, the hose passing around the reel and to the supply buoy to provide heave compensation therefor.

15. The facility of claim 14 wherein the unloading mechanism includes vertically arranged legs, the reel sliding upwardly and downwardly therealong.

16. The facility of claim 12 wherein the unloading mechanism is gimballed to the dome to move in response to ocean currents.

17. The facility of claim 16 wherein the gimbal includes a first yoke adapted to mount a box for pivoting motion about a first axis and the box mounts a second yoke attached to a plate, the second yoke and plate adapted to pivot about a second axis orthagonal to the first axis, the plate being secured thereto substantially the remainder of the unloading mechanism, the unloading mechanism further including piping between the dome and the plate for supplying oil to the tanker, the piping having a first coupling to permit the piping to pivot with the box about the first axis and a second coupling to permit the piping to pivot with the plate about the second axis to accommodate the gimballed motion of said unloading mechanism.

18. The facility of claim 12 wherein the facility includes means for mooring the tanker and releasing means includes a latch which releases the supply buoy from the submerged unloading mechanism in response to the act of mooring the tanker to the facility.

19. The facility of claim 18 wherein the supply buoy is tethered to a line extending from the unloading mechanism to a marker buoy at the surface, the latch holding the line and the submerged supply buoy, the mooring means including a fitting adapted to be submerged along the line and to connect to the facility to moor the tanker, the fitting also releasing the latch to free the supply buoy to surface.

20. An offshore oil storage and transfer facility for placement in a fully submerged state at a selected site on an ocean floor comprising:

a dome having an inner wall defining a closed chamber for receiving and storing oil and an outer wall spaced outwardly from the inner wall to define a closed pocket disposed about the chamber, the inner wall at an uppermost portion thereof defining aperture means communicating between the chamber and an upper portion of the pocket, the outer wall defining port means laterally therethrough in a lower portion thereof communicating a lower portion of the pocket to the dome exterior, an oil flow conduit having an inlet end in the chamber adjacent to the bottom of the chamber, the conduit extending to an upper exterior location on the dome for connection to duct means for flow of oil therethrough from the dome to a discharge location at an ocean surface, means for supplying oil to be stored to the chamber, the effective fluid containment volume of the chamber being a selected amount greater than the effective fluid containment volume of the pocket with the ratio of the chamber volume to the pocket volume being defined with reference to the water depth at the selected site, whereby in use of the dome at the selected site, a bubble of air can be defined in the dome for movement from the chamber through the aperture means to the pocket in response to supply of oil to the chamber during which water in the pocket flows therefrom through the port means and for movement from the pocket through the aperture means to drive oil in the chamber above the conduit inlet end through the conduit with sufficient pressure to drive oil to the water surface during which water flows into the pocket from outside the dome through the port means.

21. A method for storing oil and the like at a submerged location on the floor of an ocean and the like and for dispensing stored oil from the location, the method including the steps of:

(a) establishing on the ocean floor at said location a storage structure defining a relatively inner liquid storage chamber and a relatively outer passive pocket so disposed that the pocket is in communication with the storage chamber at an uppermost location in the storage chamber and the pocket has at least one port to the sea at a lower portion thereof, including cooperatively defining the storage and pocket volumes with respect to the depth of submergence of the port and with respect to each other that the volume of the chamber from above the port to the communication between the chamber and the pocket is a selected amount less than the volume of the storage chamber;

(b) establishing in the storage structure a volume of gas sufficient to essentially fill the storage chamber at a pressure corresponding essentially to the hydrostatic pressure of water outside the structure at a depth corresponding to the depth of the communication between the chamber and pocket below the water surface;

(c) introducing oil to be stored into the storage chamber at a pressure at least equal to the hydrostatic pressure of water outside the structure at the depth of the port to the pocket, thereby to displace the volume of gas from the storage chamber to the pocket and to displace water in the pocket to the sea through the port; and (d) dispensing oil from the storage chamber to a desired place outside the storage structure through a flow line communicating with a lower portion of the storage chamber essentially by opening the flow line for flow of oil therethrough, in response to which hydrostatic pressure outside the storage structure via the port is effective upon the volume of gas to displace the gas into the storage chamber and to urge oil in the storage chamber to flow through the flow line.

22. An underwater oil storage facility comprising:

at least one polyhedron-shaped inner module having an interior void adapted to receive and store crude oil;

a plurality of polyhedron-shaped outer modules similar to said inner modules, said outer modules attached to the inner module to, in cooperation with the sea floor, protectively surround the inner module and to prevent escape of crude oil;

means for filling said inner module with oil; and means for emptying said inner module of oil to a transportation vessel.

23. The oil storage facility of claim 22 wherein the inner modules consist of fourteen-sided polyhedra.

24. The oil storage facility of claim 22 wherein the outer modules are substantially similar to the inner modules.

25. The oil storage facility of claim 22 wherein the outer modules are concrete.

26. The oil storage facility of claim 25 wherein the inner modules are concrete.

27. The oil storage facility of claim 22 wherein the inner modules consist of fourteen-sided truncated octahedrons.

28. The oil storage facility of claim 27 wherein each inner module has eight hexagonal sides and six square panels, the inner modules interconnected and having passageways providing communication between the interiors of adjacent modules to define a storage chamber.

* * * * *